US005507691A

United States Patent [19]

Nishizawa

[11] Patent Number: 5,507,691

[45] Date of Patent: Apr. 16, 1996

[54] VENTILATOR

[75] Inventor: Keisuke Nishizawa, Tokyo, Japan

[73] Assignee: Seiho International, Inc., Pasadena, Calif.

[21] Appl. No.: 349,084

[22] Filed: Dec. 2, 1994

[30] Foreign Application Priority Data

Jan. 31, 1994 [JP] Japan ..... 6-009979
Apr. 25, 1994 [JP] Japan ..... 6-086921

[51] Int. Cl.[6] ..... F24F 13/14

[52] U.S. Cl. ..... 454/279; 454/281

[58] Field of Search ..... 454/273, 277, 454/278, 279, 281, 313, 315, 320, 333

[56] References Cited

U.S. PATENT DOCUMENTS 2,505,147 4/1950 Scallon ..... 454/277
2,789,792 4/1957 Davis ..... 454/278 X
2,966,169 12/1960 Reece ..... 454/333 X
3,179,034 4/1965 Fain ..... 454/315

*Primary Examiner*—Harold Joyce
*Attorney, Agent, or Firm*—Koda and Androlia

[57] ABSTRACT

A ventilator for buildings comprising a cylindrical main body which is open at both ends and provided with a plurality of seating members installed at attachment holes opened in the cylindrical circumferential wall of the main body. The seating members having surfaces conforming to the curvature of the cylindrical main body and also having perpendicular ends for holding the slats securely by screws.

6 Claims, 4 Drawing Sheets

VENTILATOR

BACKGROUND OF THE INVENTION

1. Field of the Invention

The present invention relates to a ventilator for cleaning the air inside the rooms of buildings.

2. Prior Art

Presently, there are many different types of ventilators for circulating the air between the inside and the outside of the rooms of a building. One type of the ventilators uses a plurality of pivoting slats. These slats are arranged in cross formation and installed in vertical and horizontal directions in a square frame. Both ends of each slat are attached to the opposite or facing side edges of the square frame in a pivotal fashion.

In this type of conventional ventilator, both ends of each slat are kept in contact perpendicularly with the inner wall surfaces of the side edges of the square frame. Accordingly, projecting pieces are used for mounting the slats. The projecting pieces are provided so as to project perpendicularly from the inside wall surfaces of the frame, and holes formed at both ends of the slat are fitted over these projecting pieces so that the slats can pivot.

However, if the frame is round in shape and not a square, it is difficult to install a plurality of slats in a pivotal fashion and in a cross formation inside the round frame.

SUMMARY OF THE INVENTION

Accordingly, it is a primary object of the present invention to provide a ventilator that includes a plurality of slats installed in a cross-form configuration inside a round frame in a manner that the slats can pivot.

The object of the present invention is accomplished by a unique structure for a ventilator that uses seating members. The ventilator of the present invention includes a round or shallow cylindrical main body and a plurality of slats which are arranged in a cross-form configuration inside the round frame and then screw-mounted to the round frame via seating members. The seating members have central screw holes and are made of elastic materials so as to be snugly fitted at attachment holes opened in the main body. Screws are passed through the screw holes of the seating members and led into threaded holes (that has internal thread) opened at both ends of the slots so that the slats are held at both ends in a pivotal fashion.

The seating members are made from elastic materials and can be in two types: a two-piece seating member and a one-piece seating member. The two-piece seating member comprises an inside piece and an outside piece which, when mounted, respectively project on inner and outer surfaces of the cylindrical main body. The inside and outside pieces have contact ends which come into contact with the main body surfaces. The contact ends are slanted or curved so as to conform to the curved surface of the main body. On the other hand, the one-piece seating member is a single cylindrical body unit having a larger diameter portion and a smaller diameter portion which are separated by a central contact end that is slanted or curved so as to conform to the curved surface of the round main body.

When the slats are installed in the round main body, the seating members are first fitted at the attachment holes of the main body, and the slats are positioned so that the threaded holes of the slats are aligned with the screw holes of the seating members. Then, the screws are inserted into the screw holes of the seating members and turned until the screws mesh with the internal threads of the threaded holes of the slats. The slats are thus installed in a pivotal fashion by the screws in the cylindrical main body via the seating members.

The seating members are positioned in the main body in a manner that the axes are parallel to the imaginary diameter lines of the cylindrical main body. End surfaces of the seating members located inside and outside of the main body are at right angles relative to the axes of the seating members. Accordingly, screws can be easily and securely inserted into the screw holes of the seating members and into the threaded holes of the slats.

In addition, due to the elasticity of the seating members and also to the slanted or curved surfaces of the seating members, the slats and the seating members can be snugly and firmly fastened to the main body by the screws. Furthermore, the slats can be pivoted smoothly so as to be set at any desired angle for a most efficient air circulation.

DETAILED DESCRIPTION OF THE INVENTION

Figure 1:
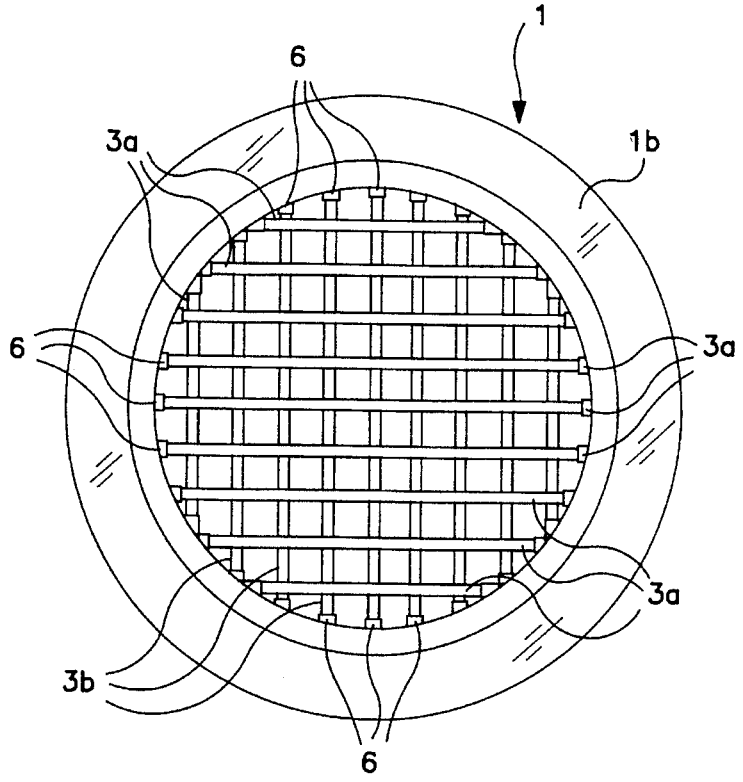
FIG. 1 is a front view of the ventilator according to the present invention.

One embodiment of the present invention will be described below in detail with reference to the accompanying drawings.

In the Figures, reference numeral 1 refers to the ventilator, and the ventilator 1 comprises a round cylindrical main body 1*a* and a flange 1*b*.

Figure 3:
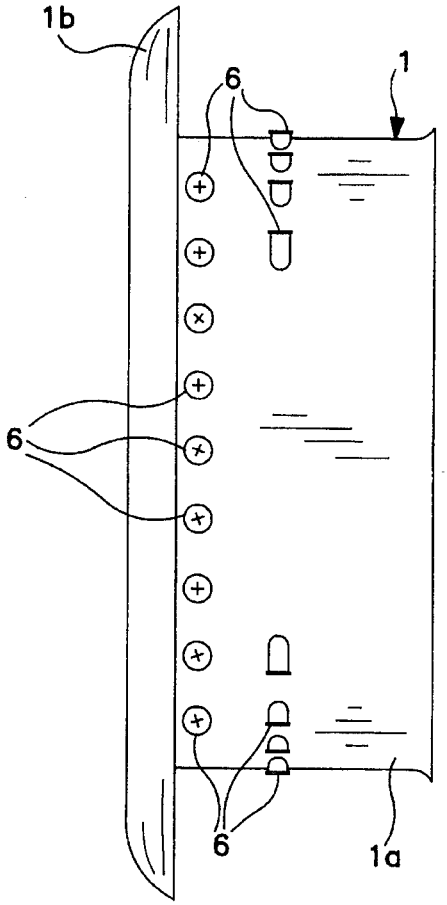
FIG. 3 is a right side view thereof.

The main body 1*a* is made of, for example, a thin metal sheet or made from plastic shaped into a shallow cylinder, and the flange 1*b* projects radially outwardly from, as seen from FIG. 3, the front edge of the main body 1*a*. When the ventilator 1 is installed, the cylindrical main body 1*a* is set in a hole opened in the building wall (not shown), and the flange 1*b* is brought into contact with the surface of the building wall.

Figure 4:
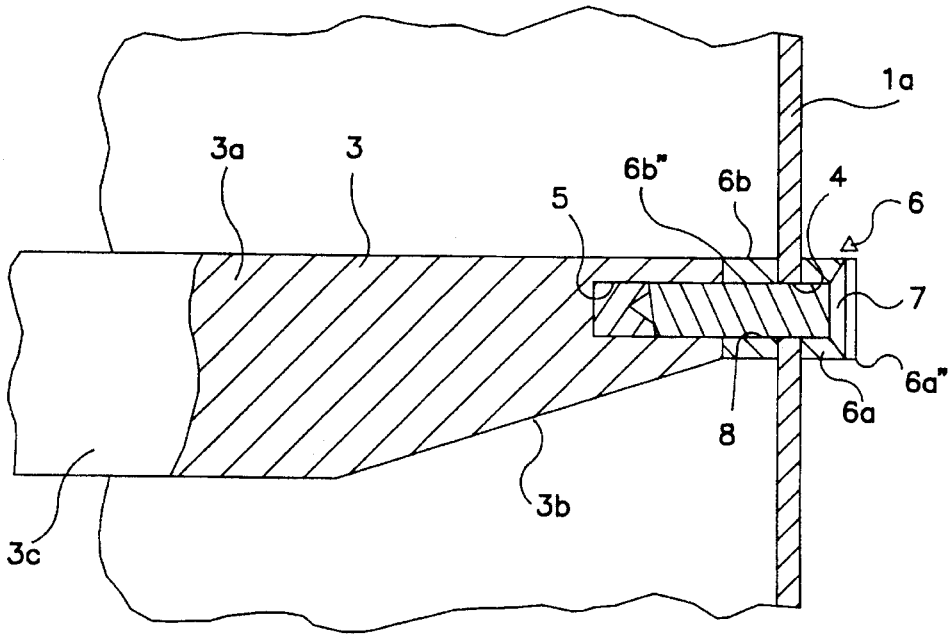
FIG. 4 is a cross section taken along the line 4—4 in FIG. 2.
Figure 7:
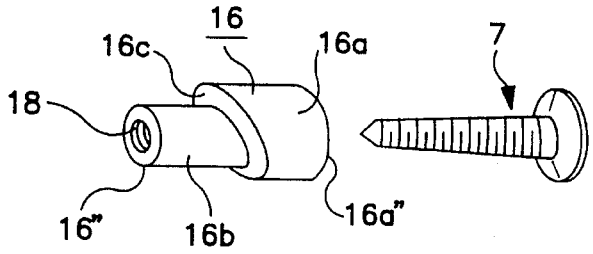
FIG. 7 shows the seating member and screw used in the ventilator according to the second embodiment of the present invention.
Figure 8:
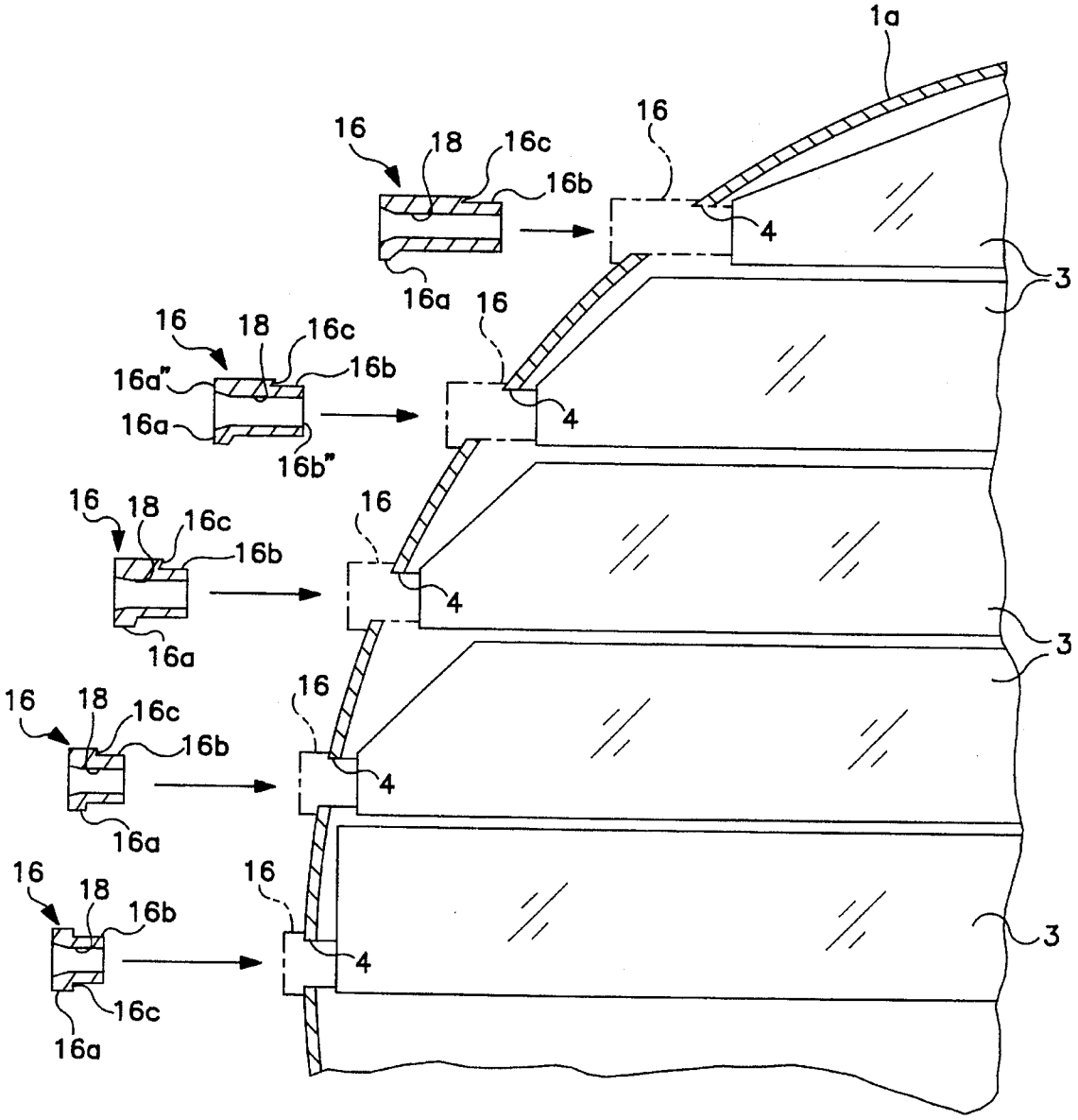
FIG. 8 shows an installation of the seating members of FIG. 7 in the ventilator.

The main body 1*a* is provided with a plurality of attachment holes 4 as seen in FIGS. 4, 7 and 8. The attachment holes 4 are oriented so as to be parallel to the imaginary diameter line of the round main body 1*a*. FIG. 4 shows one of the attachment holes 4. A holding screw 7 is brought to pass through the attachment hole 4 via the seating member 6 so that the tip end of the screw 7 is led into a threaded hole 5, that has an internal thread, of a slat 3. When the chip end of the screw 7 is brought into the threaded hole 5, the tip end of the screw 7 is engaged with the internal thread of the threaded hole 5. The slat 3 is thus held in the main body 1*a* via the screw 7 and seating member 6.

Figure 2:
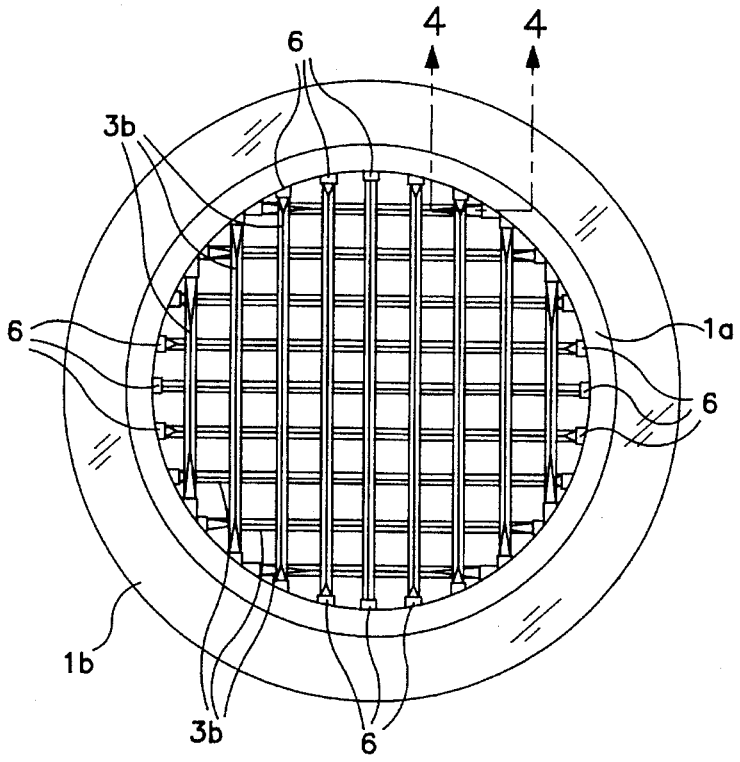
FIG. 2 is a rear view thereof.

More specifically, in the embodiment of FIG. 1, nine (9) horizontal slat 3*a* and nine (9) vertical slats 3*b* are provided in the main body 1*a*. As seen in FIGS. 1 and 2, the horizontal slats 3*a* are on the front side of the main body 1*a* and the vertical slats 3*b* are on the rear or back side of the main body 1*a*. Thus, the horizontal and vertical slats 3*a* and 3*b* are put in a cross positional relationship or in cross formation.

In other words, the screw attachment holes are opened spacedly in the main body 1*a* so that the horizontal and vertical slats 3*a* and 3*b* are oriented parallel to imaginary horizontal and vertical diameter lines, respectively, of the cylindrical main body 1*a* and to cross each other at right angles. Thus, nine (9) attachment holes are opened on the right and left sides of the main body 1*a* for the horizontal slats 3*a*, and nine (9) attachment holes are opened on the upper and lower sides of the main body 1*a*. The front slats 3*a* and the rear slats 3*b* are positioned horizontally and vertically, respectively, between the attachment holes 4 and held by the holding screws 7 through the seating members 6. An overall network configuration is resulted by the slats 3*a* and 3*b* as seen in FIGS. 1 and 2.

Figure 5:
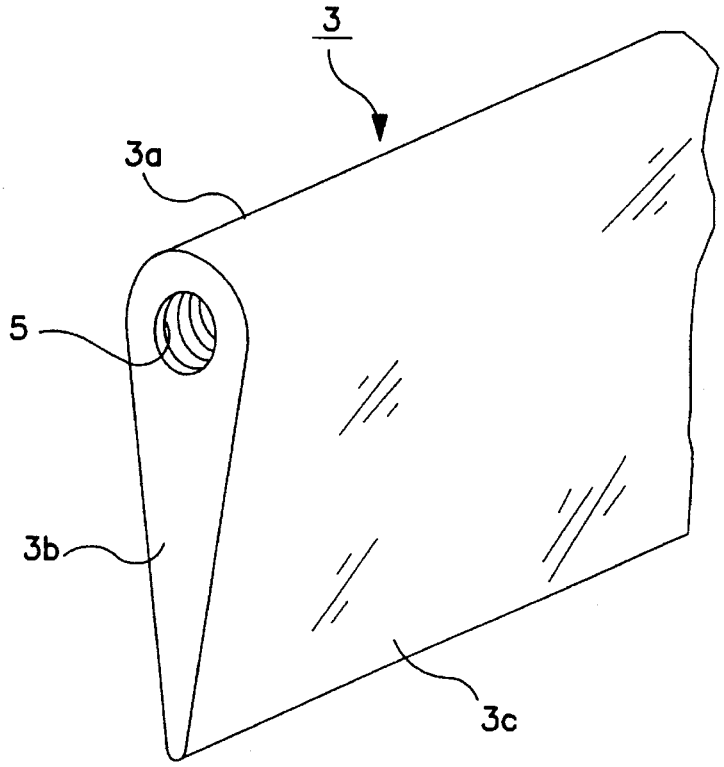
FIG. 5 shows one end of a slat used in the ventilator of the present invention.

The slats 3 are made from, for example, metal. It can be plastic. As seen from FIG. 5, one side (or front side) 3*a* of the slat 3 is formed thick and the other side (or rear side) 3*c* thereof is formed thinner for smooth air flow. Both ends 3*b* of the slat 3 are shaped obliquely (see FIGS. 2 and 4), and threaded holes 5 are formed at both ends of the thick side 3*a* of the slat 3. Holding screws 7 are screwed into these threaded holes 5 through the seating members 6, and as a result, the slats 3 are held inside the cylindrical main body 1*a* by the screws 7.

A more detailed description of the seating member 6 will be described below.

Figure 6:
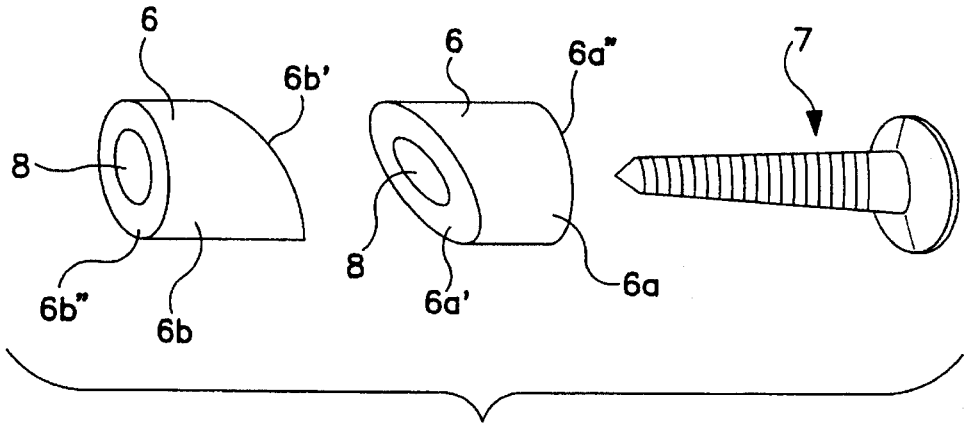
FIG. 6 shows the seating member and screw used in the ventilator according to the first embodiment of the present invention.

Each one of the seating members 6 is made of an elastic material such as nylon, plastic, etc. The seating member 6 shown in FIG. 6 is a two-piece type and has a screw through-hole 8 along the axis. The seating member 6 is obtained by obliquely dividing a single cylindrical body into two at the middle so that a pair of outer piece 6a and inner piece 6*b* make a single seating member 6. The outer piece 6a has an outside contact end 6*a'*, and the inner piece 6*b* has an inside contact end 6*b* 'which face each other. When the seating member 6 is mounted to the main body 1*a*, the outside contact end 6*a'* of the outer piece 6*a* comes into contact with the outer surface of the main body 1*a*, and the inside contact end 6*b'* of the inner piece 6*b* comes into contact with the inner surface of the main body 1*a*.

When installed, the seating members, each comprising a pair of outer and inner pieces 6*a* and 6*b*, are set at both ends of each slat 3. Thus, the seating members 6 of roughly the same shape (particularly at the angle of the contact surfaces 6*a'* and 6*b'*) are used for the slats 3 of the same length.

The angles of slant of the contact ends 6*a'* and 6*b'* vary depending upon where on the main body 1*a* a particular seating member is installed. The seating members for the top and bottom horizontal slats and for the right and left end vertical slats have the most acute angle of slanting. The angle of slanting gradually becomes less acute for the seating members to be installed near the center of the main body 1*a*. For the seating members 6 installed on the imaginary horizontal and vertical diameter lines of the cylindrical main body 1, the seating members have almost no slanted ends, and their end surfaces (6*a'* and 6*b'*) are substantially perpendicular to the axis line of the cylindrical seating member.

The end surfaces 6*a"* and 6*b"* which are on the other side of the contact ends 6*a'* and 6*b'* are perpendicular to the axial line of the inner and outer pieces 6*a* and 6*b*.

As described above, the contact ends 6*a'* and 6*b'* have slanted surfaces relative to the axis line of each seating member. Instead, the contact ends can be of curved surfaces so that the contact ends can snugly comply with the round surface of the main body 1*a*.

In assembling, as seen from FIG. 4, the outside piece 6*a* of the seating member 6 is set on the outer surface of the main body 1*a* and the inside piece 6*b* of the seating member 6 is set on the inner surface of the main body 1*a*. In this case, the screw hole 8 of the seating member 6 is aligned with the attachment hole 4 of the main body 1*a*.

Because of the slanted or curved configurations and the materials of the seating members, the contact ends 6*a'* and 6*b'* of the outside and inside pieces of the seating member 6 can snugly contact with the round surface of the cylindrical main body 1*a*. In addition, the outside end surfaces 6*a"* of the outer pieces 6*a* and the inside end surfaces 6*b"* of the inner pieces 6*b* for the horizontal slats can be perpendicular when the seating members 6 are installed in the attachment holes 4; and furthermore, the outside end surfaces 6*a"* of the outer pieces 6*a* and the inside end surfaces 6*b"* of the inner pieces 6*b* for the vertical slats can be horizontal when the seating members 6 are installed in the attachment holes 4.

Accordingly, the holding screws 7 are easily brought into the screw through-holes of the seating members 6. Thus, installation of the slats 3, which is done by bringing the holding screws 7 into the screw holes 8 of the seating members 6 and then screwing into the threaded holes 5 of the slats 3, is significantly easy.

When nine (9) horizontal or front side slats 3*a* and nine (9) vertical or rear side slots 3*b* have been installed in the cylindrical main body 1*a*, the installed slats exhibit a network form or a cross-configuration. Since the slats are installed by the holding screws 7, the slats can be pivoted about the screws 7. Thus, the slats can be adjusted smoothly and easily at preferred angles.

FIG. 7 shows a seating member 16 of the second embodiment of the present invention. The seating member 16 is a one-piece type.

This seating member 16 is substantially a single cylindrical body having a head section 16*a* and a leg section 16*b*. The head section 16*a* is larger in diameter than the leg section 16*b*, and these two sections are parted by a curved contact end 16*c*. The contact end 16*c* is to be brought into contact with the outer surface of the cylindrical main body 1*a*, and the leg section 16*b* is snugly inserted into the attachment hole 4 that is opened in the main body 1*a*. The diameter of the head section 16*a* is larger than that of the attachment hole 4, and the diameter of the leg section 16*b* is substantially the same as the attachment hole 4. The seating member 16 has an axially directed central screw through-hole 18.

The curvature of the contact end 16*c* varies depending upon where on the main body 1*a* a particular seating member 16 is installed. The seating members used for the top and bottom slats and for the right and left end slats have the largest curvature, and the curvature gradually becomes less for the seating members which are installed at the center of the main body 1*a*.

Instead of the curved surface on the contact end 16*c*, the contact end 16*c* may have a slanted flat surface. For the seating members 16 installed on the imaginary horizontal and vertical diameter lines of the cylindrical main body 1, the contact ends are substantially flat and perpendicular to the axis lines of the seating members 16.

In assembling, as seen from FIG. 8, the seating members 16 are inserted into the attachment holes 4 of the main body 1*a* from outside. The leg sections 16*b* of the seating members 16 are located inside the main body 1*a* and the contact ends 16*c* are brought into contact with the outer surface of the main body 1*a* so that the head sections 16*a* of the seating members 16 remain outside the main body 1*a*.

Because of the appropriate curvature of the contact end 16*c* of each seating member 16, the seating members 16 are brought into a full contact via the contact ends 16*c* with the outer surface of the main body 1*a*. In addition, the outside end surfaces 16*a*" and the inside end surfaces 16*b*" of the seating member 16 for the horizontal slats can be perpendicular when the seating members 16 is installed in the attachment holes 14; and furthermore, the outside end surfaces 16*a*" and the inside end surfaces 16*b*" of the seating member 16 for the vertical slats can be horizontal when the seating members 16 are installed in the attachment holes 14.

Accordingly, the holding screws 7 are easily brought into the screw through-holes 18 of the seating members 16, and the installation of the slats 3, which is done by bringing the holding screws 7 into the screw holes 18 of the seating members 16 and then screwing into the threaded holes 5 of the slats 3, is significantly easy.

When nine (9) horizontal or front slats 3*a* and the nine (9) vertical or rear slots 3*b* have been installed in the cylindrical main body 1*a*, the slats show a network form or a cross-configuration as shown in FIGS. 1 and 2. Since the slats 3 are held by the holding screws 7, the slats 3 can be pivoted about the holding screws 7 so that they are adjusted at preferred angles smoothly.

Various modifications are possible within the spirit of the present invention, and the present invention naturally extends to all such modifications.

As seen from the above, according to the present invention, slats are installed by screws inside the cylindrical main body of a ventilator through the seating members which are made of an elastic material. The contact ends of the seating members which come into contact with the round main body surface are shaped so as to snugly fit on such a surface. Since the slats are installed by holding screws through the seating members, the slats can be pivoted easily about the installing screws. In addition, as a result of the elasticity of the seating members, the attachment strength of the slats is maintained appropriately, and the pivoting motion of the slats can be accomplished smoothly.

I claim:

1. A ventilator in which a plurality of slats are pivotally installed in a cross-form configuration inside a cylindrical main body which is open at both ends, comprising:

screw holes formed at both ends of each of said slats, seating members which are made of elastic materials and have screw through-holes formed therein at positions facing said screw holes of said slats, said seating members being installed on both inside and outside surfaces of said cylindrical main body, and surfaces of said seating members which contact side walls of said cylindrical main body being formed slanted so as to conform to a curved surface of said cylindrical main body, and when said slats are positioned so as to face attachment holes opened in said cylindrical main body for installation, screws are inserted from said outside surface into said seating members installed on said inside and outside surfaces of said attachment holes so that said screws are screwed into said screw holes formed at said ends of said slats.

2. A ventilator in which a plurality of slats are pivotally installed in a cross-form configuration inside a cylindrical main body which is open at both ends, comprising:

screw holes formed at both ends of each of said slats, attachment holes opened in said cylindrical main body so as to face said screw holes of said slats, seating members to be installed in said attachment holes, each one of said seating members being a single body provided with a screw through-hole and having a head section and a leg section which are parted by a step surface, said head section being larger in diameter than said attachment hole, said step surface being formed so as to snugly conform to an outer surface of said cylindrical main body, and said leg section being inserted into said attachment hole so that tip end of said leg section projects toward inside from inner surface of said cylindrical main body so as to face said slat, and screws inserted into said screw through-holes of said seating members so that tip ends of said screws are screw engaged with said screw holes opened at both ends of said slats, thus installing said slats in said cylindrical main body.

3. A ventilator comprising:

a cylindrical main body which is open at both ends and provided with a plurality of slat attachment holes on a cylindrical circumferential wall of said main body:

a plurality of seating members provided at said attachment holes, each one of said seating members being provided with an axial through hole; and a plurality of slats provided inside said cylindrical main body, said slats being pivotally attached to said seating members by screws; and wherein;

said seating members are provided so that axial through holes of said seating members are parallel to two imaginary diameter lines of said cylindrical main body which cross at right angles each of said seating members is a cylindrical single body having a large diameter head section and a smaller diameter leg section which are parted by a contact end surface that has a shape conforming to a curvature or said cylindrical main body, said leg section being inserted in said attachment hole of said main body so as to project inwardly.

4. A ventilator according to claim 3, wherein each one of said slats is installed between two seating members which face each other at inner end surfaces of said seating members so that said slats are arranged in a cross-configuration.

5. A ventilator according to claim 3, wherein each one of said slats are formed round at both ends.

6. A ventilator according to claim 3, wherein each one said slats are formed diagonal at both ends.

* * * * *